United States Patent [19]

Wachi

[11] Patent Number: 4,619,217

[45] Date of Patent: Oct. 28, 1986

[54] APPARATUS FOR CLEANING UNDERWATER SURFACES

[75] Inventor: Kiyoshi Wachi, Machida, Japan

[73] Assignee: Macsea Marine Services Co., Inc., Tokyo, Japan

[21] Appl. No.: 687,424

[22] Filed: Dec. 28, 1984

[30] Foreign Application Priority Data

Apr. 4, 1984 [JP] Japan ..... 59-49566[U]

[51] Int. Cl.[4] ..... B63B 59/10

[52] U.S. Cl. ..... 114/222; 15/194

[58] Field of Search ..... 114/222; 15/1.7, 87, 15/183, 194

[56] References Cited

U.S. PATENT DOCUMENTS

| | | | |
|---|---|---|---|
| 1,780,221 | 11/1930 | Buchmann | 15/194 |
| 2,283,293 | 5/1942 | Steiert | 15/194 |
| 2,875,460 | 3/1959 | Legge | 15/194 |
| 3,204,280 | 9/1965 | Campbell | 15/87 |
| 3,599,264 | 8/1971 | Smith et al. | 15/194 |
| 3,649,984 | 3/1972 | Kershaw et al. | 15/183 |
| 3,946,692 | 3/1976 | Sierra et al. | 114/222 |
| 4,052,950 | 10/1977 | Hirata | 114/222 |

*Primary Examiner*—Trygve M. Blix
*Assistant Examiner*—Stephen P. Avila
*Attorney, Agent, or Firm*—Wenderoth, Lind & Ponack

[57] ABSTRACT

An apparatus for cleaing underwater surfaces including at least one rotatable brush and pump for producing a stream of water from the front to the rear thereof. The brush and pump are axially reciprocable in a housing. The brush has bundles of bristles, each bundle having a head portion fitted into notches at the periphery of a main ring and held therein by a pinch ring, the main and pinch rings together constituting a brush base which is detachably secured to a rotatable base associated with the pump, by means of a pair of fixed members which are engagable upon relative rotation of the rotatable base and brush base.

12 Claims, 10 Drawing Figures

APPARATUS FOR CLEANING UNDERWATER SURFACES

BACKGROUND OF THE INVENTION

1. Field of the Invention

The present invention relates to an apparatus for removing substances stuck to underwater surfaces of ships or other structures, such as seaweed and shells, and for cleaning the underwater surfaces.

2. Description of the Prior Art

A conventional cleaning apparatus comprises rotary brush for use underwater and a pump for forming a water jet stream from the front side to the rear side of said rotary brush. The cleaning apparatus is usually towed by a diver so that the front side of said rotary brush abuts against the fouled surface of underwater structure and handled so as to rotate the rotary brush by actuating the pump. The front side of the rotary brush is stuck to the underwater structure owing to the jet stream formed by the driving of pump, and fouling stuck to the surface of the underwater structure is removed by the rotation of said rotary brush.

When there are spots which should not be subjected to friction with the brush during the cleaning operation by means of such cleaning apparatus, the cleaning should be removed from the surface or the rotary brush should be stopped, each time the brush reaches such a spot. Since the rotary brush and pump are driven integrally, it is very difficult to remove the cleaning apparatus from the fouled surface of the underwater structure while the rotary brush is rotating. Hence, contact of the rotary brush with such spots is avoided usually by stopping the rotation of said rotary brush. As a result, said rotary brush can be separated very easily from said spots, but the pump is also stopped by the stopping of rotary brush, so that the cleaning apparatus comes off from the fouled surface of the underwater structure, resulting in the very troublesome requirement of shifting the cleaning apparatus to the subsequent fouled surface and restoring it to the original position.

In addition, the structure surface has various types of foulings such as seaweed, shells, etc. stuck thereto under varied sticking conditions and the surface to be cleaned is not uniform, so that it is preferable to select and use a rotary brush with bristles having hardness, density, etc., suitable correspondingly to the types of fouling, how it is stuck to the surface and the condition of the surface to be cleaned.

The conventional cleaning apparatus has disadvantages that its rotary brush is not easily detachable and takes time and labour to replace the rotary brush. Further, there are insufficient types of rotary brushes available so as to be able to select the appropriate brush depending on the types of fouling, how it is stuck to the surface and the condition of the surface to be cleaned.

SUMMARY OF THE INVENTION

In view of such disadvantages of conventional cleaning apparatuses, the present invention provides a cleaning apparatus for cleaning the surface of underwater structures, which features: a rotary brush which is made detachable from the fouled surface of the underwater structure, even during rotary brush rotation and while the cleaning apparatus is in contact with the fouled surface of the underwater structure, thereby facilitating the cleaning of the surface containing some spots to be avoided; easy detachability of the rotary brush from the cleaning apparatus so as to expedite the cleaning operation; and detachability of a bundle of bristles, so that a suitable bundle of bristles can be selected to form a suitable brush, depending upon the kinds and condition of foulings and the state of the surface to be cleaned.

The cleaning apparatus according to this invention comprises rotary brushes capable of being brought into contact with the fouled surface of the underwater structure and pumps for forming jet streams from the front to the rear sides of the side rotary brushes. Further, the rotary brushes are supported by said cleaning apparatus proper in such a manner that the rotary brushes can be freely moved reciprocally in their regular and reverse directions and the cleaning apparatus proper is provided with a reciprocating mechanism which can freely move the respective rotary brushes reciprocally. The rotary brushes are fixed detachably to rotors which have been fixed at the rotation-driving side. At the base of the rotor and rotary brush, connecting fixed members are provided which connect to each other by rotation at mutually relative small angles, and for the rotary brushes, said base members are formed by two rings which mutually come into contact with each other. One of the rings has notches at suitable intervals on its outer circumference, and the head of a bundle of bristles which have a bulge at their head is connected with said notches. When the other ring is superimposed on this ring, the bulge at the head of the bundle of bristles is sandwiched by the two rings.

BRIEF DESCRIPTION OF THE FIGURES

The figures illustrate an embodiment of this invention.

DESCRIPTION OF THE PREFERRED EMBODIMENT

Figure 1:
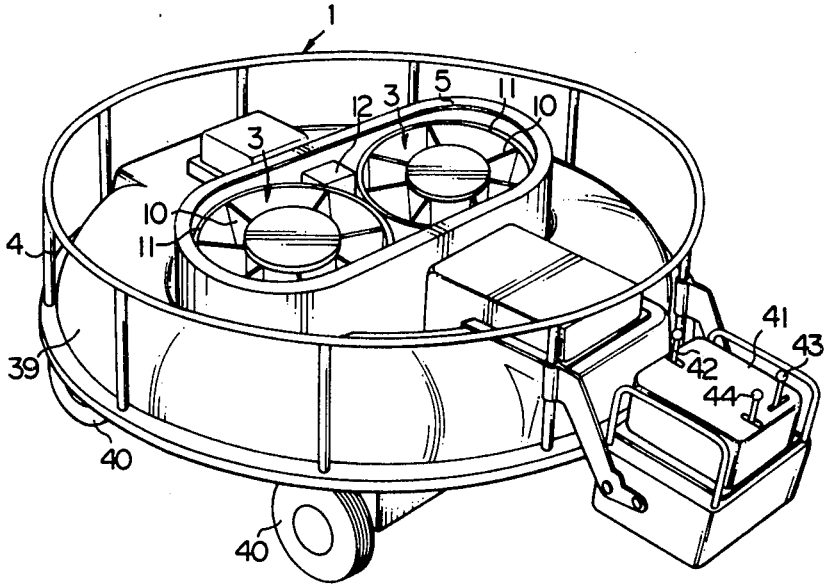
FIG. 1 is a perspective view of the cleaning apparatus.
Figure 2:
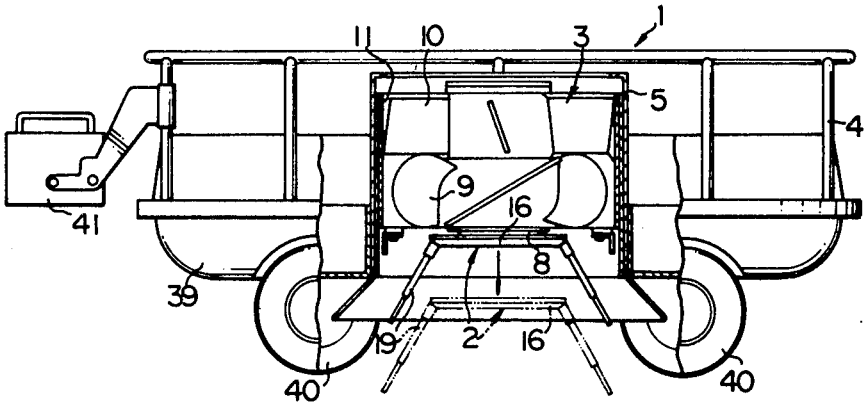
FIG. 2 is a partial front view of the notch of the cleaning apparatus proper shown in FIG. 1.
Figure 3:
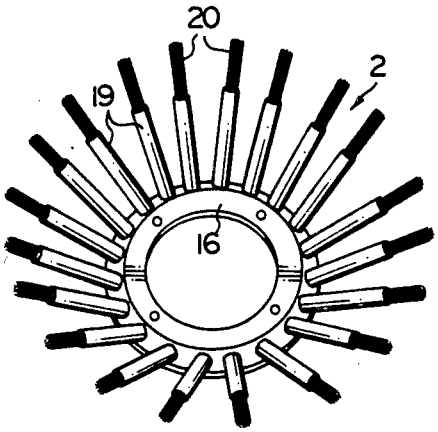
FIG. 3 is a perspective view of an embodiment of rotary brush.
Figure 4:
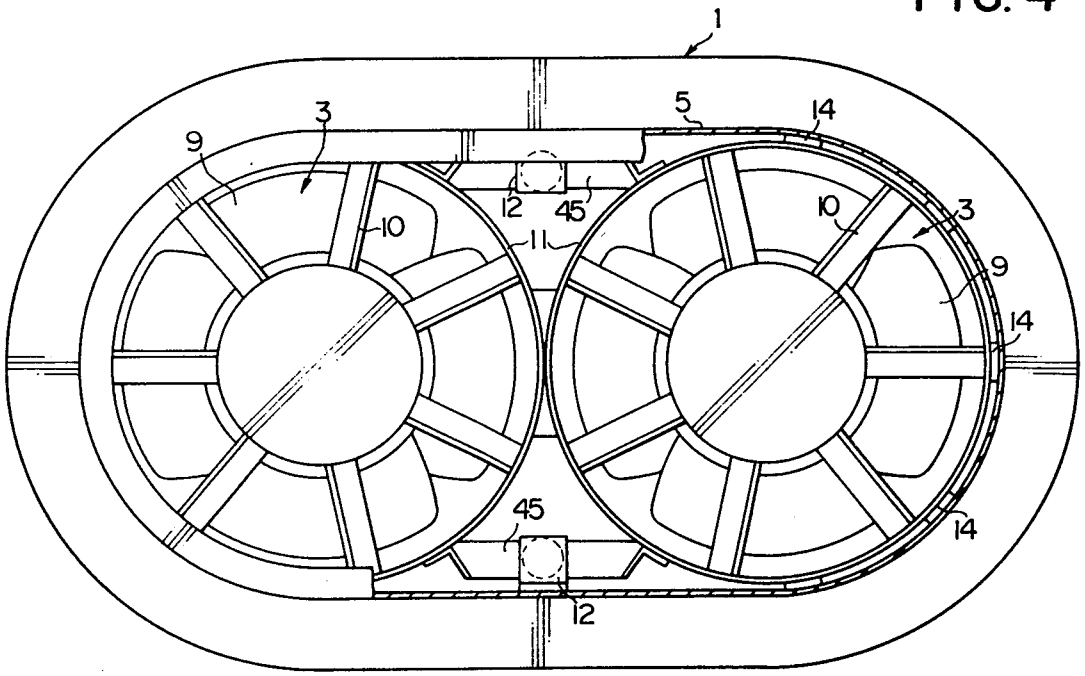
FIG. 4 is a plan view of the central portion of the cleaning apparatus proper.
Figure 5:
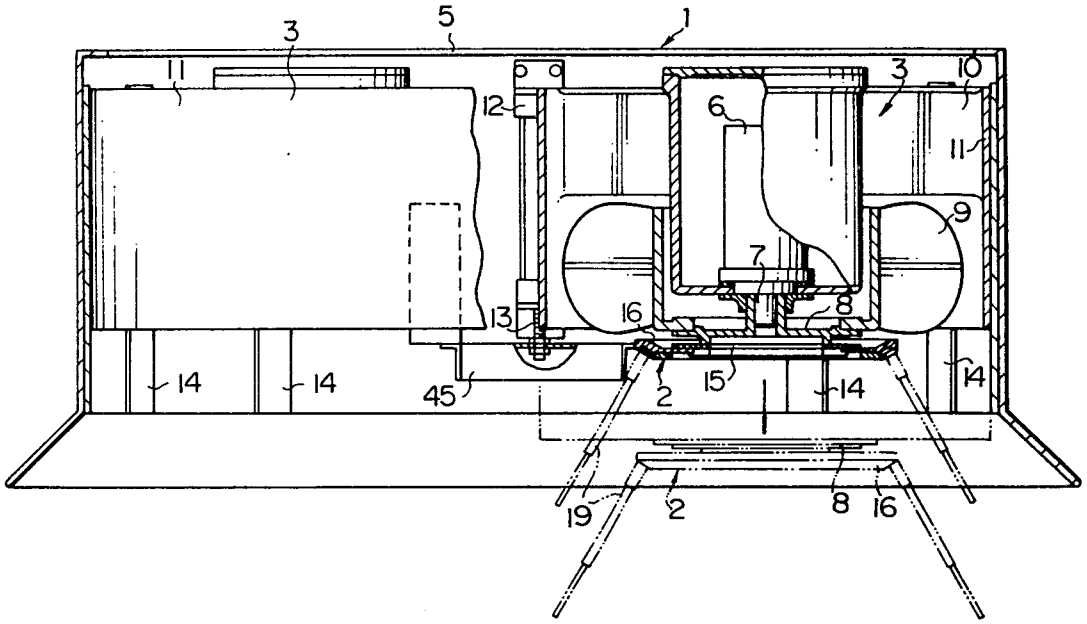
FIG. 5 is a partial front view of the central portion of the cleaning apparatus proper shown in FIG. 4.
Figure 6:
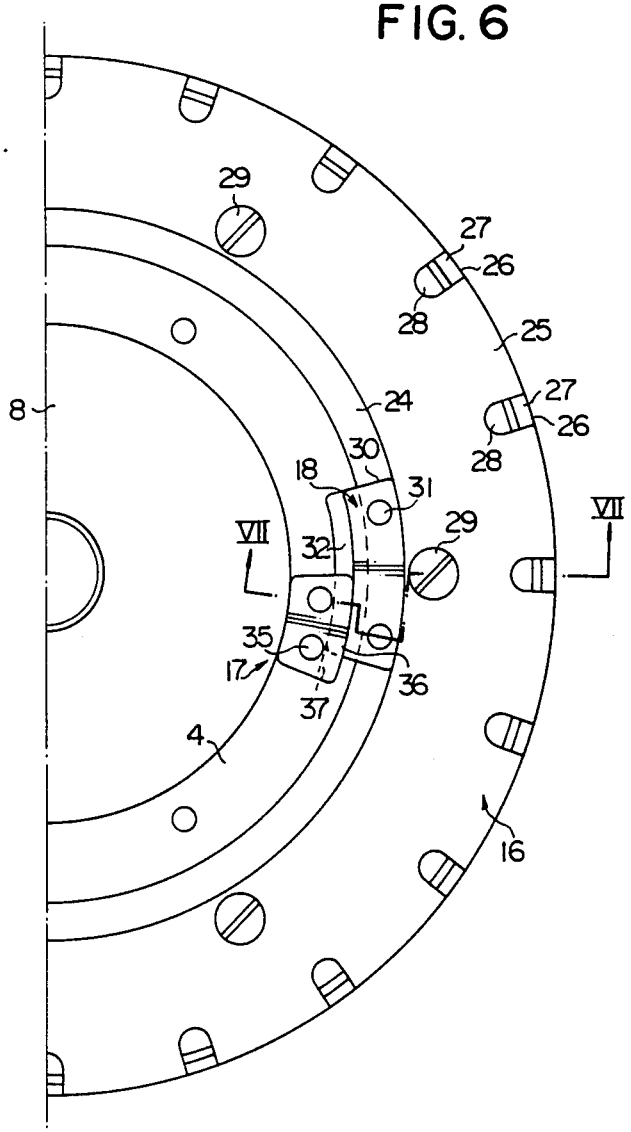
FIG. 6 is a plan view illustrating the rotary brush and the connecting fixed member for connecting the rotary brush and the rotor.
Figure 7:
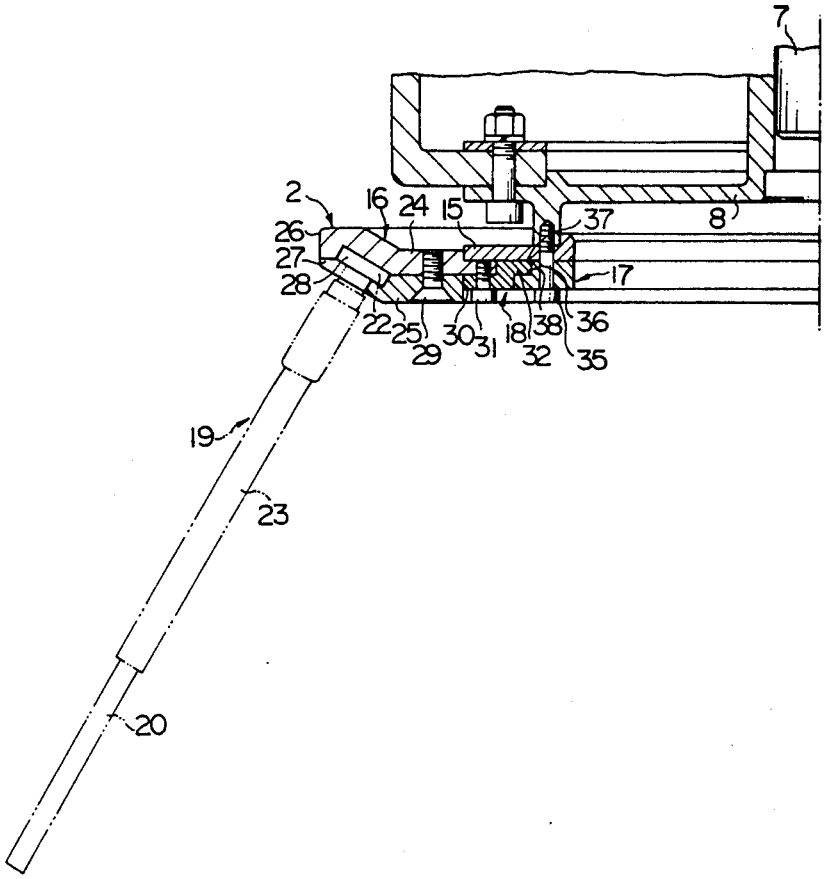
FIG. 7 is a sectional view taken along line VII—VII of FIG. 6.

The following will describe the present invention in detail based on the preferred embodiment shown in the attached figures.

In the figures, reference numeral 1 designates the cleaning apparatus proper. This cleaning apparatus proper 1 is provided with two rotary brushes 2 capable of being contacted with the surface of underwater structure to be cleaned and two pumps 3 for forming jet streams from the front to the rear sides of said rotary brushes 2. These rotary brushes 2 and pumps 3 are located in a draft tube 5 provided in an annular frame 4. Each of said pumps 3 consists of an impeller 9 which is fixed to a rotary base 8 fitted to a rotary shaft 7 of a hydraulic motor 6 which provides the driving power, flow straightening vanes 10 for converting the vortex flow formed by the revolution of impeller 9 to uniform flow, and a casing 11 for containing the impeller 9 and vanes 10. Said rotary brush 2 is fixed detachably to said rotary base 8 for pump 3 and pump 3 and rotary brush 2 are rotated integrally by driving hydraulic motor 6.

The casing 11 comprising the outer frame for said pump 3 is supported reciprocally from the front to rear side of said rotary brush 2 fixed to pump 3 in draft tube 5, and rotary brush 2 fixed to pump 3 is designed to be reciprocated with the reciprocal motion of said casing 11, i.e. that of pump 3. The reciprocal shifting of pump 3 through draft tube 5 is guided by guide liners 14 fitted in draft tube 5.

Reference numeral 12 designates a hydraulic cylinder comprising the reciprocal mechanism for reciprocating each of said rotary brushes 2 by reciprocating each of said pumps 3. These hydraulic cylinders 12 are equipped in draft tube 5. Reference numeral 13 designates two cylinder rods for the hydraulic cylinders 12 and these cylinder rods 13 are connected with casings 11 for said pumps 3 via connectors 45 so as to reciprocate casings 11 and thus pumps 3 by elongating and contracting of cylinder rods 13 by the action of hydraulic cylinders 12. The displacement of pumps 3 dictates the displacement of rotary brushes 2 so that when for movement of pumps 3 by hydraulic cylinders 12, pumps 3 are displaced to the rear side of rotary brushes 2, rotary brushes 2 fixed to pumps 3 are contained in draft tube 5 and when pumps 3 are displaced to the front side of rotary brushes 2, rotary brushes 2 fixed to pumps 3 are caused to protrude from draft tube 5 so that the bristles of the rotary brushes 2 contact the surface to be cleaned under the condition that the cleaning apparatus proper 1 is connected with said surface. Accordingly, rotary brushes 2 can be brought into contact with or separated from the surface to be cleaned by manipulating hydraulic cylinders 12 without stopping the rotation of rotary brushes 2 under the condition that the cleaning apparatus proper 1 is connected with the surface.

There will be explained the structure for fixing rotary brushes 2 to rotary base 8 and structure of rotary brushes 2.

Each rotary brush 2 is fixed detachably to rotary base 8 via a rotor 15. The rotor 15 may be a ring as shown in the figures or a disk. For the purpose of fixing rotary brush 2 to this rotor 15, connecting fixed members 17 and 18 are provided which connect to rotor 15 and base 16 of rotary brush 2—that comes into contact with rotor 15—respectively by mutually relative small-angle rotations, and rotary brush 2 is fixed to rotor 15 by connecting the connecting fixed member 17 to 18. Such connecting fixed members 17 and 18 will be referred to hereafter.

Figure 8:
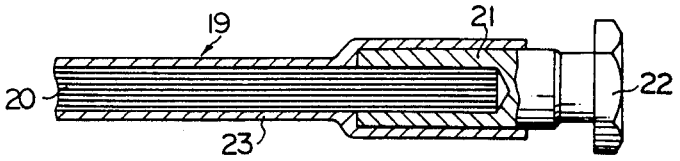
FIG. 8 is an enlarged sectional view of a portion of a bundle of bristles for the rotary brush.

The rotary brush 2 is composed of said base 16 and a bundle of bristles 19 fitted around said base 16. As shown in FIG. 8, a bundle of bristles 19 consistos of a bundle of wires 20, supporter 21 for holding the bundle of wires 20, bulge 22 fitted at the head of supporter 21 and rubber tube 23 for covering the supporter 21 and a portion of the bundle of wires 20. Wires 20 are made of steel or synthetic resin wires or of an appropriate mixture of steel and synthetic resin wires. Many different bundles of bristles 19 of wires 20 are prepared.

Figure 9:
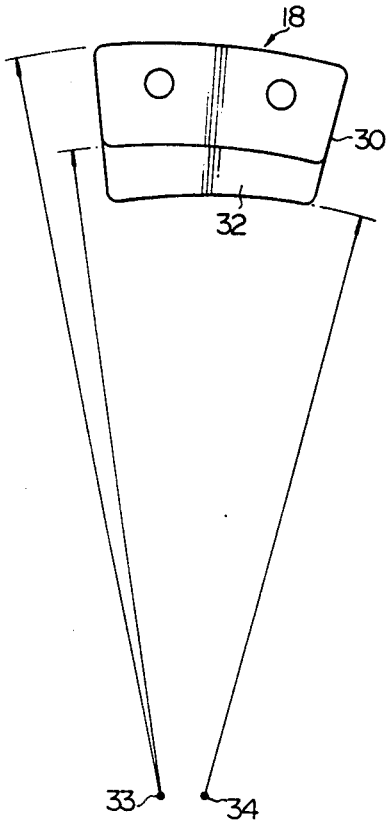
FIG. 9 is a plan view of the connecting fixed member fixed to the base of the rotary brush.

The base 16 is composed of main or rear ring 24 and pinching or front ring 25 which are fixed to each other by contacting them and connecting them with bolts 29. Main ring 24 is provided with flange portion 26 at the outer periphery and pinching ring 25 has U-shaped notches 27 in a proper pitch around the outer periphery. When main ring 24 and pinching ring 25 are in contact and fixed, the tip of flange portion 26 of main ring 24 contacts the outer periphery of pinching ring 25 to form an annular groove 28 between main ring 24 and pinching ring 25. The notches 27 are open to said annular groove 28. When bundle of bristles 19 is fixed to base 16, the bulge 22 provided at the head of a bundle of bristles 19 is connected with notches 27 of pinching ring 25, and pinching ring 25 is mounted against main ring 24 under such a condition as to fix the bundle of bristles 19. Thereby, bulge 22 of the bundle of bristles 19 is pinched and fixed by main ring 24 and pinching ring 25. Bolts 29 may have split heads (like a screw) and pinching ring 25 in annular groove 28. Reference numeral 29 designates bolts for mounting together and fixing main ring 24 and pinching ring 25. Bolts 29 may have split heads (like a screw) as shown in the figures by a head having crossed holes (i.e. a Phillips screw) or hexagonal shaped may also be used. As set forth hereinabove, said connecting fixed members 18 are provided inside main ring 24 forming base 16, for rotary brush 2 in a proper pitch. These connecting fixed members 18 have crank-like sections having inner and outer arcs and the outer arc comprises a fixed piece 30 and fixed to main ring 24 by bolt 31. The inner arc comprises a connecting member 32. Connecting fixed members 18 are fixed to main ring 24 so as to register the outer periphery of connecting fixed members 18 with the inner periphery of pinching ring 25 mounted and fixed by main ring 24. As shown in FIG. 9, the centre of curvature 33 for the outer arc of connecting fixed members 18 is not registered with the centre of curvature 34 for the inner arc because the connecting member 32 becomes radially thicker in the rotational direction of rotary brush 2.

Figure 10:
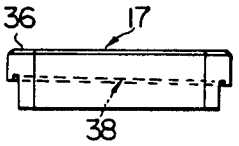
FIG. 10 is a rear view of the connecting fixed member fixed to the rotor.

On the other hand, other connecting fixed members 17 provided on said rotor 15 for fixing rotary brush 2 have a sectional form of approximately L-shape and secured on the face of rotor 15 by means of bolt 35 at the position corresponding to connecting fixed members 18 fitted on base 16 of said rotary brush 2 so as to be open to the outer peripheral direction and to form connecting groove 37 for inserting and engaging connecting members 32 of said connecting fixed members 18 between fastening member 36 of connecting fixed members 17 and the face of rotor 15. As shown in FIG. 10, connecting face 38 of fastening member 36 has an inclined surface so as to reduce successively the clearance connecting face 38 and the face of rotor 15 in the direction opposite to the rotational direction of rotary brush 2.

When rotary brush 2 is fixed to rotor 15, connecting member 32 for connecting fixed members 18 provided on rotary brush 2 is connected with connecting groove 37 defined between fastening member 36 for the connecting fixed members 17 provided on rotor 15 and rotor 15 so as to insert connecting member 32 into connecting groove 37 from the rotational direction of rotary brush 2 and to turn rotary brush 2 to the revise direction to the rotational direction of said rotary brush 2. Since said connecting groove 37 has continuously reduced clearance to the adverse direction to the rotational direction of rotary brush 2 and connecting member 32 has continuously increased width to the rotational direction of rotary brush 2, connecting member 32 is grasped in connecting groove 37 more firmly and pinched more strongly with the increased revolution of said rotary brush 2 to the reverse direction to the rotational direction thereof and the inner tip of connecting member 32 is concurrently pressed forcedly against the inner side of connecting groove 37 to fix rotary brush 2 to rotor 15. When rotary brush 2 is rotated for cleaning the fouled surface, rotary brush 2 is applied with stronger force to the adverse direction so that rotary brush 2 is fixed more firmly to rotor 15 to prevent the detaching of rotary brush 2 from rotor 15 during the cleaning operation. Rotary brush 2 can be detached easily from rotor 15 by rotating rotary brush 2 to the rotational direction of rotary brush 2. When connecting member 32 is stuck excessively to connecting groove 37 to make the rotation of said rotary brush 2 to the rotational direction of rotary brush 2 difficult, bolt 35 for fixing the connecting fixed members 17 for connection to rotor 15 is loosened to widen the clearance of connecting groove 37 and rotary brush 2 is rotated to the rotational direction of said rotary brush 2, thereby disengaging the connecting members 32 of connecting fixed members 18 from connecting groove 37 to remove rotary brush 2 from rotor 15.

Reference numeral 39 designates a buoy, and reference numeral 40 represents wheels fitted to the side of rotary brush 2 for cleaning apparatus proper 1, i.e. the fixed side with the surface to be cleaned. These wheels 40 are arranged on four points and each wheel 40 is driven by a respective hydraulic motor (not shown). The cleaning apparatus proper 1 is fixed with the surface to be cleaned by the rotation of said pumps 3 and is designed to move the surface by drive of wheels 40. Reference numeral 41 designates a control panel and reference numerals 42, 43 and 44 designate operation levers which are manipulated by the diver to effect the aforementioned operations to effect the cleaning operation.

As referred to hereinbefore, the cleaning apparatus according to this invention are provided with the rotary brushes capable of being brought into contact with the fouled surface of an underwater structure and the pumps for forming jet water streams from the front to rear sides of said rotary brushes, said rotary brushes being supported reciprocally from the front to rear sides of said rotary brushes on the cleaning apparatus proper and the cleaning apparatus proper being provided with a reciprocating mechanism for reciprocating said rotary brushes. Accordingly, said rotary brushes can be displaced from the front side of said rotary brushes, i.e. the fixed direction of said rotary brushes to the surface to be cleaned to the rear side of said rotary brushes, i.e. the separating direction of said rotary brushes from said surface to be cleaned. Accordingly if there are spots where friction should be avoided by the rotary brushes on said surface, said rotary brushes can be displaced in the direction separating them from the rear sides of said rotary brushes or the surface to be cleaned under the condition that the cleaning apparatus proper is fixed to the surface without stopping the rotations of pumps and rotary brushes to separate the rotary brushes from said surface and the rotary brushes can pass such spots without the friction by separating the rotary brushes from the surface to be cleaned in a aforementioned manner and transporting the cleaning apparatus proper. When the cleaning apparatus proper passes over such a spot, the rotary brushes are fixed again with the surface to be cleaned by propelling the rotary brushes in the front direction of said rotary brushes or the fixed direction to the surface and restarting the cleaning operation. Accordingly, the cleaning operation is facilitated and improves the operational efficiency.

In addition, in the cleaning apparatus, the rotary brushes are fixed detachably to the rotor fixed at the rotating power side, the rotors and bases of rotary brushes are provided with connecting fixed members capable of being connected by the mutually relative rotation thereof through a small angle and the bases of rotary brushes comprise respective two rings capable of contact with said base, the outer periphery of one ring being notched in a proper pitch for connecting the bulge at the head of respective bundles of bristles and another ring mounted on the former ring to pinch said bulge to fix the bundle of bristles to the base. Accordingly, the rotary brushes can be fitted to or detached from the cleaning apparatus proper simply, easily and rapidly. Since the bundle of bristles for the rotary brush can be fitted detachably, easily and simply, the optimum rotary brush for removing fouling can be available easily by selecting the optimum bundle of bristles from a number of bundles of bristle depending on the fouling and the condition of surface to be cleaned.

What is claimed is:

1. A cleaning apparatus for cleaning an underwater surface, comprising:

a housing;

rotary brushes having brush bases, mounted in said housing, having a front side for engaging the underwater surface, and a rear side opposite said front side;

water pumps mounted in said housing having means for pumping streams of water from said front side to said rear side of said brushes; and means for rotating said brushes, said rotating means including for each said brush, a rotatable rotor having a rotor base and means for detachably fixing said rotor to said each brush, said detachably fixing means including a first fixing member fixed to said brush base and a second fixing member fixed to said rotor base adjacent said first fixing member, said first and second fixing members having means for detaching and attaching together said first and second fixing members by relative small angle rotation of said rotor and said said brush;

each brush base including a front ring and a rear ring rearward of, concentric with, superposed over, and detachably fixed to said front ring, said front ring having a plurality of circumferentially spaced apart notches opening into the radial periphery thereof, said brushes further comprising bundles of bristles extending generally forwardly through said notches and having head portions rearward of said notches between said front ring and said rear ring, said rear ring comprising means for sandwichingly fixing said head portions between said front ring and said rear ring such that said bundles are radially removable from said notches to thereby remove the bundles entirely from said each brush base, when said front ring is detached from said rear ring.

2. An apparatus as in claim 1, wherein said means for sandwichingly fixing said head portions comprises a flange at the radial periphery of said rear ring engaging said head portions and said radial periphery of said forward ring.

3. An apparatus as in claim 2, wherein said notches are U-shaped.

4. An apparatus as in claim 2, wherein said front and rear rings have an annular groove defined therebetween bounded radially outwardly by said flange, said notches opening rearwardly into said groove, said head portions being fixed in said groove.

5. A cleaning apparatus for cleaning an underwater surface, comprising:

a housing;

rotary brushes having brush bases, mounted in said housing, having a front side for engaging the underwater surface, and a rear side opposite said front side;

water pumps mounted in said housing having means for pumping streams of water from said front side to said rear side of said brushes; and means for rotating said brushes, said brushes being detachably mounted to said rotating means;

said brush bases each including a front ring and a rear ring rearward of, concentric with, superposed over, and detachably fixed to said front ring, said front ring having a plurality of circumferentially spaced apart notches opening into the radial periphery thereof, said brushes further comprising bundles of bristles extending generally forwardly through said notches and having head portions rearward of said notches between said front ring and said rear ring, said rear ring comprising means for sandwichingly fixing said head portions between said front ring and said rear ring such that said bundles are radially removable from said notches when said front ring is detached from said rear ring.

6. An apparatus as in claim 5, wherein said means for sandwichingly fixing said head portions comprises a forwardly extending flange formed on the radial periphery of said rear ring engaging said head portions and said radial periphery of said forward ring.

7. An apparatus as in claim 6, wherein said notches are U-shaped.

8. An apparatus as in claim 6, wherein said front and rear rings have an annular groove defined therebetween bounded radially outwardly by said flange, said notches opening rearwardly into said groove, said head portions being fixed in said groove.

9. A cleaning apparatus for cleaning an underwater surface, comprising:

a housing;

a rotary brush having a brush base, mounted in said housing, having a front side for engaging the underwater surface, and a rear side opposite said front side;

a water pump mounted in said housing having means for a pumping stream of water from said front side to said rear side of said brush; and means for rotating said brush, said brush being detachably mounted to said rotating means;

said brush including a front ring and a rear ring rearward of, concentric with, superposed over, and detachably fixed to said front ring, said front ring having a plurality of circumferentially spaced apart notches opening into the radial periphery thereof, said brush further comprising bundles of bristles extending generally forwardly through said notches and having head portions rearward of said notches between said front ring and said rear ring, said rear ring comprising means for sandwichingly fixing said head portions between said front ring and said rear ring such that said bundles are radially removable from said notches when said front ring is detached from said rear ring.

10. An apparatus as in claim 9, wherein said means for sandwichingly fixing said head portions comprises a forwardly extending flange formed on the radial periphery of said rear ring engaging said head portions and said radial periphery of said forward ring.

11. An apparatus as in claim 10, wherein said notches are U-shaped.

12. An apparatus as in claim 10, wherein said front and rear rings have an annular groove defined therebetween bounded radially outwardly by said flange, said notches opening rearwardly into said groove, said head portions being fixed in said groove.

* * * * *